United States Patent [19]

Isshiki

[11] Patent Number: 4,731,279

[45] Date of Patent: Mar. 15, 1988

[54] ASSEMBLY BLOCK FORMED FROM A POLY-OLEFIN FOAM

[75] Inventor: Tadao Isshiki, Kure, Japan

[73] Assignee: Rakkasan Company Ltd., Tokyo, Japan

[21] Appl. No.: 26,332

[22] Filed: Mar. 16, 1987

[30] Foreign Application Priority Data

Mar. 20, 1986 [JP] Japan ..... 61-62880
Jul. 11, 1986 [JP] Japan ..... 61-164322

[51] Int. Cl.[4] ..... B32B 3/02; B32B 3/10; B32B 3/26

[52] U.S. Cl. ..... 428/159; 428/33; 428/101; 428/131; 428/138

[58] Field of Search ..... 428/33, 101, 131, 134, 428/135, 136, 137, 138, 159, 316.6

[56] References Cited

U.S. PATENT DOCUMENTS 3,857,749 12/1974 Yoshida ..... 428/33
3,940,811 3/1976 Tomikawa et al. ..... 428/131

FOREIGN PATENT DOCUMENTS 1963304 6/1971 Fed. Rep. of Germany ..... 428/33
2835428 2/1979 Fed. Rep. of Germany ..... 428/131
55-17561 2/1980 Japan ..... 428/316.6
1218789 1/1971 United Kingdom ..... 428/138

*Primary Examiner*—William J. Van Balen
*Attorney, Agent, or Firm*—Armstrong, Nikaido, Marmelstein & Kubovcik

[57] ABSTRACT

Blocks which can be used for assembling easily and inexpensively a piece of furniture or a part of a building, such as a table, stool, gate or arch. Each block comprises a molded body of a polyolefin foam having a rectangular, circular, oval or polygonal cross-section. The body has a pair of opposite surfaces of which one is provided with a plurality of regularly spaced apart holes, while the other surface is provided with a plurality of regularly spaced apart projections of which each can be fitted into one of the holes of another block. At least one bore extends through the body between the opposite surfaces thereof. The blocks are so light in weight and easy to handle that any assembly thereof can easily be dismantled for rebuilding another assembly having a different shape or structure. They are also highly resistant to water and are, therefore, suitable for building any assembly for outdoor use.

8 Claims, 14 Drawing Figures

FIG. 9
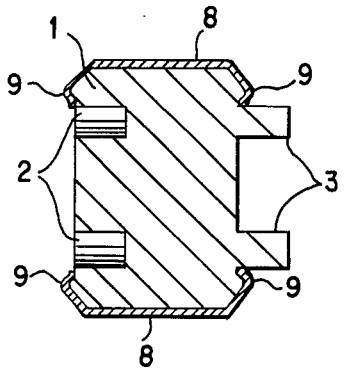
FIG. 10
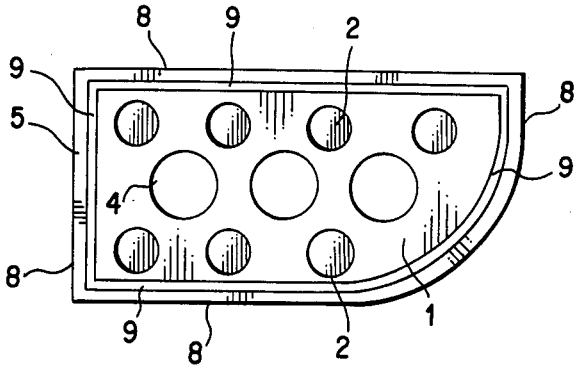
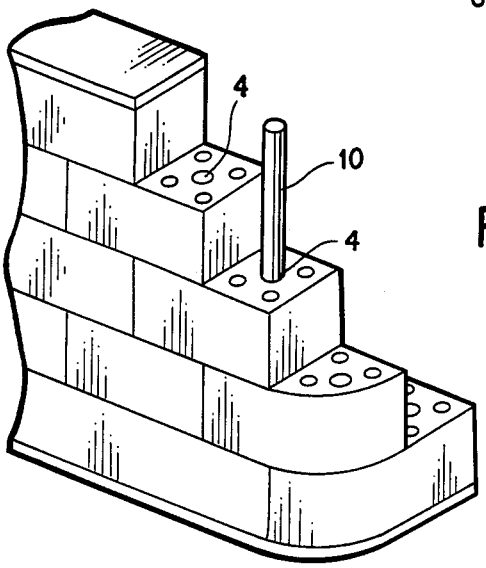
FIG. 11

ASSEMBLY BLOCK FORMED FROM A POLY-OLEFIN FOAM

BACKGROUND OF THE INVENTION

1. Field of the Invention

This invention relates to an assembly block formed from a polyolefin foam. More particularly, it is a block which can be used for assembling easily and inexpensively a piece of furniture or a part of a building, such as a table, stool, chair, room partition, shelf, display, planter, gate or arch.

2. Description of the Prior Art

Japanese Laid-Open Patent Specification No. 13844/1983 (publication prior to examination) discloses a building unit which comprises a block of a polystyrene foam having a pair of opposite surfaces provided with a plurality of pins and a plurality of holes, respectively, and a plurality of additional surfaces which are not provided with any such pin or hole, but are surrounded by a reinforcing cover.

The use of a polystyrene foam, however, presents a number of problems which are due to its inherent defects. The polystyrene foam is so brittle that it is easily chipped or degressed if hit by any solid object. Therefore, protection, as by a reinforcing cover, is essentially required of any exposed surface. This protection naturally adds to the time and cost which are required for a job of assembly. As its brittleness does not permit the use of any screw, blocks of a polystyrene foam cannot be used for assembling any product having a complicated shape or structure. As a polystyrene foam does not have a satisfactorily high degree of resistance to heat or chemicals, a block formed therefrom presents a worn or corroded surface or is deformed with the lapse of time. Moreover, the distortion which develops during the molding of blocks is likely to create an undesirable clearance between the adjoining blocks which are put together, or disable the assembly of a product having a desired shape or structure.

SUMMARY OF THE INVENTION

Under these circumstances, it is an object of this invention to provide an assembly block which can overcome the drawbacks of the prior art as hereinabove pointed out.

This object is attained by a block which is formed from a polyolefin foam. It may have a rectangular, circular, oval or polygonal cross-section. It has a first surface provided with a plurality of regularly spaced apart holes and a second surface which is substantially diametrically opposite the first surface and which is provided with a plurality of regularly spaced apart projections of which each can be fitted into one of the holes of another block to join the two blocks. Each block has at least one bore which extends vertically therethrough.

BRIEF DESCRIPTION OF THE DRAWINGS

FIG. 9 is a vertical sectional view of still another type of block embodying this invention;

FIG. 10 is a top plan view of still another type of block embodying this invention;

FIG. 11 is a fragmentary perspective view of an assembly of blocks embodying this invention.

DETAILED DESCRIPTION OF THE INVENTION

According to this invention, there is provided an assembly block formed from a polyolefin foam, having a first surface provided with a plurality of regularly spaced apart holes and a second surface located vertically opposite the first surface and provided with a plurality of regularly spaced apart projections of which each can be fitted into one of the holes in the first surface of another block, and provided therethrough with at least one bore extending vertically between the first and second surfaces.

According to an additional feature of this invention, that surface or surfaces of the block which do not have any such hole or projection may be wholly or partly covered with an ornamental material, such as fabric or leather.

Figure 1:
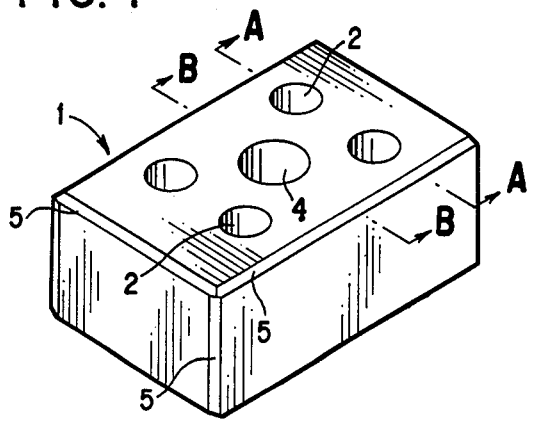
FIG. 1 is a perspective view of a block embodying this invention.
Figure 2:
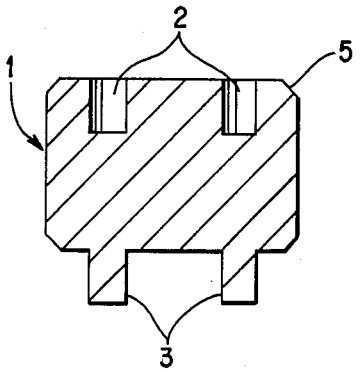
FIG. 2 is a sectional view taken along the line A—A of FIG. 1.
Figure 3:
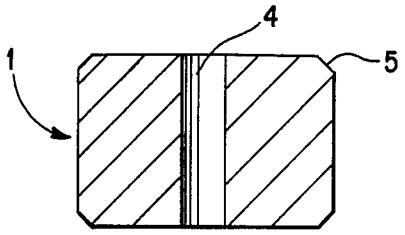
FIG. 3 is a sectional view taken along the line B—B of FIG. 1.

Several types of blocks embodying this invention will now be described by way of example with reference to the drawings. Referring first to FIGS. 1 to 3, a block 1 has a first or upper surface provided with a plurality of regularly spaced apart holes 2 and a second or lower surface provided with a plurality of regularly spaced apart projections 3. Each of the projections 3 can be fitted into one of the holes 2 in the first surface of another block. The block 1 also has a bore 4 extending vertically therethrough between its upper and lower surfaces. Each edge of each of the planes defining the block 1 has a bevelled surface 5.

The block is formed from a foam of a polyolefin resin, such as polyethylene, polypropylene or a copolymer of polyethylene and polypropylene. It is preferable to use a flame-retardant resin.

The holes 2 have such a diameter and a depth that the projections 3 of another block can be properly fitted therein. Thus, a multiplicity of blocks can be joined together to form an assembly extending in various directions in an endless pattern. The through bore 4 is provided for the insertion of, for example, a plastic, wooden or metal bar for reinforcing the assembly, as shown by way of example in FIG. 11.

There is no particular limitation to the size of the block. It depends on the dimensions of the article or structure to be assembled. It may, however, have a length ranging, say, from 10 to 100 cm, or preferably from 15 to 60 cm, to facilitate the assembly of various kinds of differently sized and shaped articles or structures. For the same reason, the number of the holes 2 or the projections 3 is preferably, say, from two to eight, though it has no limitation in particular, either. The dimensions of the holes 2 and the projections 3 do not have any particular limitation, either, but blocks having differently sized holes and projections may be selectively used for fabricating different linds of articles or structures. The holes 2 and the projections 3 may, for example, have a diameter of about 1 to 5 cm and a depth or length of about 1 to 10 cm. The bore 4 may have a diameter of, say, 1 to 5 cm which depends on the strength required of the assembly to be constructed.

Figure 4:
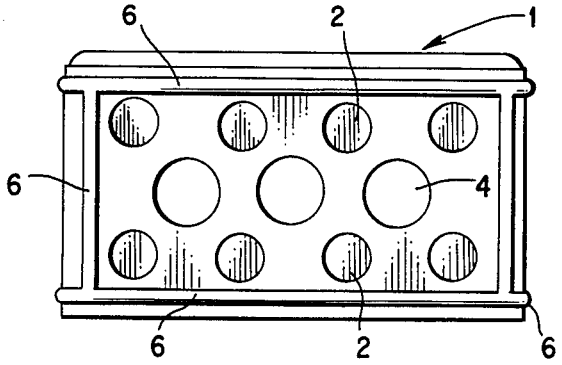
FIG. 4 is a top plan view of another type of block embodying this invention.

Another type of block embodying this invention is shown at 1 in FIG. 4. It has a plurality of ridges 6 formed thereon. The block produced by foam molding is generally likely to have, say, 2 or 3% of shrinkage or deformation. The ridges 6 are provided for making up any such shrinkage or deformation. The elasticity which is due to their material and shape allows the ridges 6 to expand or contract to enable the adjoining blocks to closely fit one another and thereby form an assembly having an improved appearance. At least two ridges 6 are, therefore, required of each block surface. Too large ridges are unsuitable for the purpose for which they are provided. It is usually appropriate for each ridge 6 to have a height not exceeding about 1 cm and preferably not exceeding about 5 mm and an equally selected width.

Figure 5:
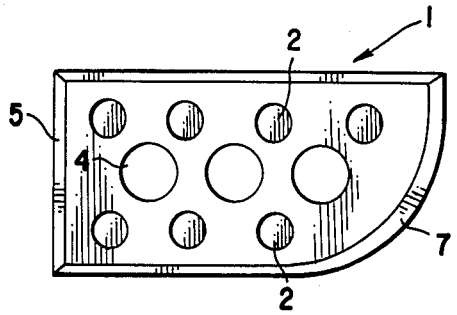
FIG. 5 is a top plan view of still another type of block embodying this invention.

Still another type of block embodying this invention is shown in FIG. 5. The block 1 has a sidewall which includes a curved surface 7.

Figure 6:
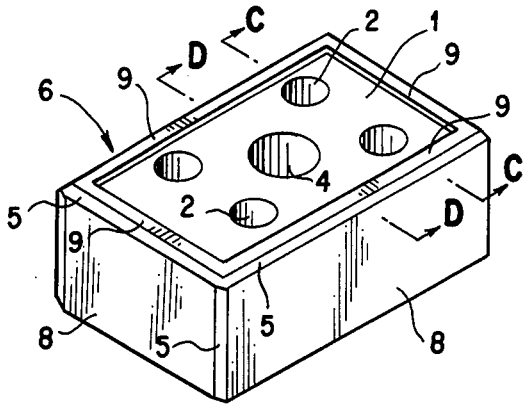
FIG. 6 is a perspective view of still another type of block embodying this invention.
Figure 7:
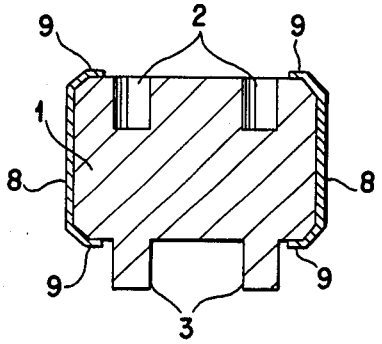
FIG. 7 is a sectional view taken along the line C—C of FIG. 6.
Figure 8:
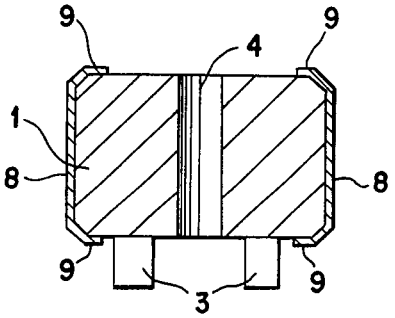
FIG. 8 is a sectional view taken along the line D—D of FIG. 6.
Figure 12:
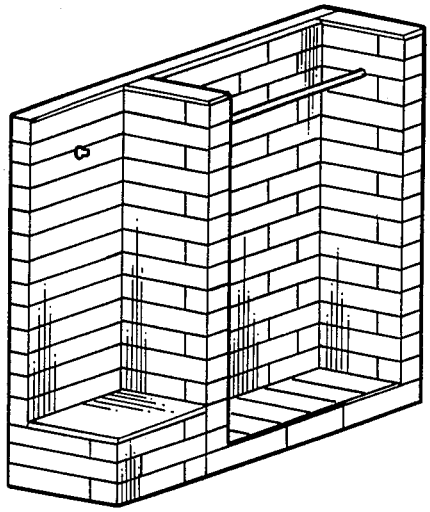
FIGS. 12 to 14 are perspective views showing by way of example some articles or structures assembled from blocks according to this invention.
Figure 13:
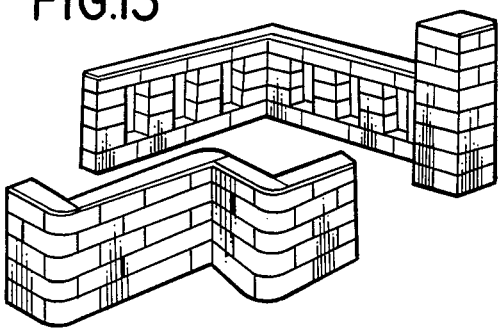
Figure 14:
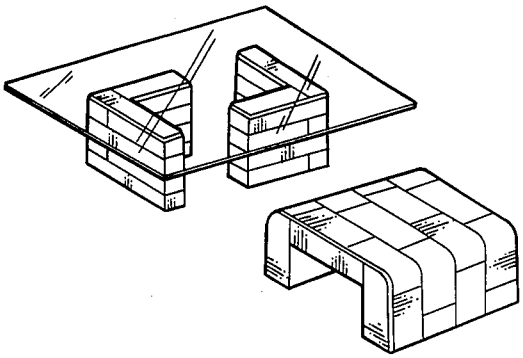

Still another type of block embodying this invention is shown in FIGS. 6 to 8. It is a modified form of the block 1 shown in FIGS. 1 to 3 and has a sidewall covered with an ornamental material 8. The ornamental material 8 has an upper edge 9 and a lower edge 9 which overlap the edges of the upper and lower surfaces, respectively. The projecting edges 9 serve for making up any distrotion of the block and allow the adjoining blocks to closely fit one another and thereby form an assembly having a good appearance.

The ornamental material 8 is preferably composed of a fabric such as velvet, a nonwoven fabric, leather, leathern cloth, synthetic leather, etc. It may be bonded to the block by an adhesive, a double-faced adhesive tape, etc., or may be melted in a solvent or by heat and applied to the block.

A modified form of the block shown in FIG. 4 is shown in FIG. 9. It has a sidewall covered with an ornamental material 8 having an upper edge 9 and a lower edge which overlap the edges of the upper and lower surfaces, respectively, of the block.

A modified form of the block shown in FIG. 5 is shown in FIG. 10. It has a sidewall covered with an ornamental material 8 having an upper edge 9 and a lower edge 9 which overlap the edges of the upper and lower surfaces, respectively, of the block.

An assembly of blocks embodying this invention as hereinabove described is fragmentarily shown by way of example in FIG. 11. It has a particular shape or structure defined by a plurality of blocks held together by the projections 3 fitted into the holes 2. The assembly is reinforced by a bar 10 inserted through the bores 4 of some of the blocks. Although only one bar 10 is shown in FIG. 11, it is, of course, usual to employ an appropriate number of bars which depends on the assembly to be produced.

The block of this invention may be colored or provided with filaments, or may have its surfaces otherwise treated. For example, pebbles, tiles or colored particles can be caused to adhere to the surfaces of the block which have been melted by the application of heat or a solvent.

The block of this invention has a large number of advantages which will hereunder be summarized:

(1) The blocks form a very safe assembly which does not hurt anybody even if he may have his leg or head struck against it;

(2) The assembly can be easily washed in water to maintain its beautiful appearance;

(3) While only a skilled person can change the covering of a conventional piece of furniture, such as a chair or stool, even an unskilled person can easily change the covering, envelope or ornamental material for any furniture assembled from the blocks of this invention to get a change of atmosphere in his room;

(4) Anybody can easily dismantle a particular assembly and reassemble the blocks into a different shape or structure to get a change of surroundings or atmosphere;

(5) The blocks are so light in weight that an assembly thereof can be easily moved when a change of surroundings is desired, when the room of a hotel or house in which it is used is cleaned, or when its user moves to another house, or the assembly can be easily dismantled if required for any such transportation purpose;

(6) The blocks are resistant to water and are, therefore, suitable for use in the construction of an outdoor gate or ornamental object, etc.;

(7) The blocks have so high a degree of heat insulating property that, for example, a room partition formed therefrom or a bookshelf formed therefrom and placed along a wall of a room can be an effective heat insulator;

(8) Whenever any assembly is unnecessary, it can be dismantled for storage in a closet to thereby enable the effective utilization of the space of a room;

(9) Even a block having a fairly complicated shape can be manufactured in a single molding operation and the blocks of this invention can, therefore, be manufactured at a low cost in a large quantity;

(10) No tick or other harmful insect grows on the blocks of this invention or any assembly thereof; and

(11) The blocks are so inexpensive that they can advantageously be used for assembling a large and complicated structure, such as a Greek or Roman type of arch.

Moreover, the block of this invention has a variety of advantages over the conventionally known block of a polystyrene foam as will hereinafter be summarized:

(1) It is not brittle, as opposed to a polystyrene foam, and is, therefore, not chipped or depressed, even if a solid object may have been struck against it;

(2) As it is not brittle, it can be joined to another block mechanically, as by screws; the blocks can, therefore, be used to construct in a wide range of shapes or structures a wide variety of assemblies which can maintain their original shape or structure for a long period of time;

(3) It is superior in oil and chemical resistance;

(4) Because of their elasticity, the blocks are suitable for assembling, for example, a stool, chair or bed; they are also strong against scratches;

(5) The elasticity of the ridges or the combined elasticity of the ridges and the ornamental material makes it possible to fill any undesirable clearance between the adjoining blocks that is due to their distortion developed during their molding or may be created when they are put together, and thereby form an assembly having a good appearance; and (6) The use of a crosslinked resin enables the manufacture of a block having excellent physical properties.

What is claimed is:

1. An assembly block comprising a molded body of a polyolefin foam having a rectangular, circular, oval or polygonal cross-section, said body having a pair of opposite surfaces of which one is provided with a plurality of regularly spaced apart holes, while the other of said surfaces is provided with a plurality of regularly spaced apart projections of which each can be fitted into one of said holes in said one surface of another block, at least one bore extending through said body between said surfaces thereof.

2. A block as set forth in claim 1, wherein said holes consist of two to eight holes provided in two rows and said projections consist of two to eight projections provided in two rows, one to six bores extending through said body, said or each bore having a pair of open ends located between said two rows of holes and between said two rows of projections, respectively.

3. A block as set forth in claim 1 or 2, wherein each edge of each plane defining said body has a bevelled surface.

4. A block as set forth in claim 1 or 2, wherein each surface of said body that is brought into contact with one surface of the body of another block when the blocks are put together is provided with at least two ridges having a height and a width both up to and including 5 mm.

5. An assembly block comprising a molded body of a polyolefin foam having a rectangular, circular, oval or polygonal cross-section, said body having a pair of opposite surfaces of which one is provided with a plurality of regularly spaced apart holes, while the other of said surfaces is provided with a plurality of regularly spaced apart projections of which each can be fitted into one of said holes in said one surface of another block, at least one bore extending through said body between said surfaces thereof, said body having at least one additional surface covered wholly or partly with an ornamental material, such as fabric or leather.

6. A block as set forth in claim 5, wherein said holes consist of two to eight holes provided in two rows and said projections also consist of two to eight projections provided in two rows, one to six bores extending through said body, said or each bore having a pair of open ends located between said two rows of holes and between said two rows of projections, respectively.

7. A block as set forth in claim 5 or 6, wherein each edge of each plane defining said body has a bevelled surface.

8. A block as set forth in claim 5 or 6, wherein each surface of said body that is brought into contact with one surface of the body of another block when the blocks are put together is provided with at least two ridges having a height and a width both up to and including 5 mm.

* * * * *